US007166192B2

(12) United States Patent
van de Steeg et al.

(10) Patent No.: US 7,166,192 B2
(45) Date of Patent: Jan. 23, 2007

(54) METHOD FOR CONTROLLING PITCH AND STICKIES DEPOSITION

(75) Inventors: Riet van de Steeg, Bennekom (NL); Raymond Koerhuis, Harderwijk (NL); Freddie L. Singleton, Switzerland, FL (US)

(73) Assignee: Hercules Incorporated, Wilmington, DE (US)

( * ) Notice: Subject to any disclaimer, the term of this patent is extended or adjusted under 35 U.S.C. 154(b) by 102 days.

(21) Appl. No.: 10/444,522

(22) Filed: May 23, 2003

(65) Prior Publication Data

US 2004/0231816 A1 Nov. 25, 2004

(51) Int. Cl.
*D21F 1/32* (2006.01)

(52) U.S. Cl. ..... 162/199; 162/272; 162/164.1; 162/175; 162/DIG. 4

(58) Field of Classification Search ..... 162/199, 162/164.1, 175, DIG. 4, 158, 176, 177, 178
See application file for complete search history.

(56) References Cited

U.S. PATENT DOCUMENTS

| | | | | |
|---|---|---|---|---|
| 3,840,489 | A | 10/1974 | Strazdins et al. | 260/29.6 |
| 3,992,249 | A | 11/1976 | Farley | 162/72 |
| 4,861,429 | A | 8/1989 | Barnett et al. | 162/199 |
| 4,886,575 | A | 12/1989 | Moreland | 162/5 |
| 5,074,961 | A | 12/1991 | Dreisbach et al. | 162/72 |
| 5,292,403 | A | 3/1994 | Dreisbach et al. | 162/158 |
| 5,723,021 | A | 3/1998 | Nguyen | 162/168.1 |
| 6,020,422 | A * | 2/2000 | Connors et al. | 524/716 |
| 6,123,760 | A | 9/2000 | Varnell | 106/174.1 |
| 2001/0023751 | A1 | 9/2001 | Kohler et al. | 162/147 |

FOREIGN PATENT DOCUMENTS

| | | |
|---|---|---|
| EP | 0 568 229 | 11/1993 |
| EP | 0 599 440 | 6/1994 |
| JP | 2002129244 | 4/2002 |
| JP | 2002281938 | 9/2002 |
| JP | 2004044067 | 8/2003 |

OTHER PUBLICATIONS

Shetty et al., Tappi J. 77, 10:91. 1994.
Philippaerts, Paper Technology 43(3) 51-56 (2000).

* cited by examiner

*Primary Examiner*—Mark Halpern
(74) *Attorney, Agent, or Firm*—Joanne Mary Fobare Rossi; Gary A. Samuels

(57) ABSTRACT

A method for controlling Pitch and Stickies is disclosed. The method comprises adding hydrophobically modified hydroxyethyl cellulose (HMHEC) and cationic polymers to a cellulosic fiber slurry (pulp) or to a paper process or to a paper making system and results in a higher degree of inhibiting organic deposition and retention of pitch on paper fiber as compared to the inhibition of the individual ingredients. The combination of HMHEC and cationic polymers surprising results in a synergistic effect.

20 Claims, 8 Drawing Sheets

Effect of Polyamine A Concentration vs. Absorbance (Deposition).

Effect of Polyamine A on Turbidity

Effect of HMHEC on Absorbance

Effect of HMHEC on Absorbance

Effect of Combinations of Polyamine A and HMHEC

Effect of Percent Polyamine on Absorbance

Effect of HMHEC and Polyamine A on Pitch Deposition in a Papermill Whitewater

Effects of Combinations of Polyamine A and HMHEC on Turbidity of a Papermill Whitewater Containing 0.75% Pulp

METHOD FOR CONTROLLING PITCH AND STICKIES DEPOSITION

BACKGROUND OF THE INVENTION

1. Field of the Invention

The present invention relates to a method of eliminating or reducing the detrimental effects resulting from deposition of organic contaminants on surfaces in paper process systems. More specifically the invention is for the use of synergistic combinations of hydrophobically modified hydroxyethylcellulose and cationic polymers to inhibit deposition of organic contaminants onto surfaces of papermaking equipment.

2. Description of Related Art

Paper production is a process during which cellulosic fibers (pulp) isolated from wood or recycled paper are suspended in water (pulp slurry) and directed to the wire section of a papermachine where water is drained from the pulp suspension to create a paper web. During subsequent processing of the paper web on the paper machine, the water content of the paper web is reduced as the paper sheet is formed and dried. While paper is produced, several different types of surfaces on the machine are contacted by the pulp slurry, the paper web, the paper sheet, as well as the water used to transport the pulp slurry. Contact with surfaces of the paper machine or components thereof can result in some contaminating organic materials in the process water stream adhering to or depositing onto the surfaces. Within pulp production or processing facilities, exposed surfaces include screen rooms and deckers. Surfaces on parts of papermachines can be made of metal, granite, ceramic, mylar, polyester, plastic, and other synthetic materials. Such surfaces include machine wires, felts, foils, uhle boxes, headbox components, press rolls, fabric carrier rolls, calendar rolls, Doctor blades, and dryer cans and fabrics. Proper operation of the paper machine requires that surfaces be reasonable free of deposits of contaminating materials. The terms "papermaking system" and "paper process system" are meant to include all processes, including pulp production, that are part of paper production.

Contaminating materials in a paper process system that deposit onto surfaces of papermaking equipment are generally referred to as pitch or stickies. In the strictest sense, pitch is a term used to refer to any organic matter originating from the extracts of wood including fatty acids and esters, resin acids, and sterols. Pitch that is not removed in the pulp mill with washers and/or cleaners can deposit on papermaking equipment surfaces. Pitch deposits may contain other materials such as defoamers, sizing agents, coatings, inorganic components (i.e., calcium carbonate, silica, clay, magnesium, and/or titanium).

If the source of the cellulosic fiber used to produce paper is recycled paper, deposits of contaminating materials may include materials referred to as stickies. Cellulosic fiber from recycled paper can include significant quantities of thermoplastic impurities that come from self-adhesive envelopes, latex in coatings, hot melts, polyethylene films, pressure sensitive adhesives, and waxes. These impurities make up stickies. Depending on the source of the cellulosic fiber (stock), stickies and pitch can form in the same deposit. A stickies deposit may include components of pitch as well as chemicals used in papermaking. The common approach to controlling stickies is to use mechanical and chemical programs. Chemical programs are designed to control contaminants that are not removed from the system during the flotation stage of the de-inking process. Chemicals used to control contaminants include talc, polymers, dispersants, and surfactants.

Pitch or stickies deposition is detrimental to efficient production of paper and the operation of paper mills. Pitch and/or stickies deposit, on surfaces exposed to the pulp slurry or process water removed during sheet formation causing operational problems in the systems. For example, modern paper machines have a variety of process monitors as integral components of the papermachine. Pitch deposits on process monitors can render these components useless. Deposits of pitch on screens can reduce throughput and cause disruptions in the operation of the paper mill. Stickies and pitch can also adversely affect the quality of the finished paper sheet. Parts of deposits can become dislodged from a contaminated surface, become integrated into the paper web, and form spots or other defects in the sheet. Deposits of stickies or pitch on rollers can cause defects on the surface of the paper.

Low concentrations of fine particles of pitch or stickies that remain well dispersed do not create a deposition problem. However, there is a tendency for the hydrophobic particles to agglomerate at the air-water interface to form larger aggregates of material, which then deposit on paper making equipment. The degree to which pitch or stickies deposit on a surface is influenced by characteristics of the pitch or stickies and of the paper process system. Characteristics or factors of the pitch or stickies include the composition and stability of the particles, size of the particles, the tendency of the particles to deposit and the amount of pitch or stickies in the systems. Characteristics of the paper processing system that influence or help determine the degree of pitch deposition includes nature of the surface, including affinity of the surface for pitch, temperature, pH, source of fiber, and degree of recycling of water within the paper mill.

Pitch and stickies control programs are system-specific because of the uniqueness of each papermill. A typical pitch control strategy can begin with the addition of nonionic or anionic surfactants that stabilize the colloidal form of the pitch in whitewater. The objective of adding a stabilizing chemical is to preserve the colloidal form of the pitch thereby preventing large agglomerations from forming and depositing on papermachine surfaces. If any pitch colloids form large agglomerations or deposit on surfaces, strongly anionic surfactants (referred to as dispersants) can be used to disperse the pitch. A negative aspect of the use of dispersants is that they can interfere with some functional chemistries such as additives used to retain the colloidal pitch in the paper sheet and sizing.

Rendering pitch and stickies particles to be less prone to deposit is only one aspect of a successful control program. In many papermaking systems, pitch and stickies must be removed from the process stream for paper production to continue. Removing pitch or stickies from paper process system will avoid having concentrations of these contaminants increase to the point that deposition becomes problematic. A common strategy to remove pitch or stickies colloids from a system is to bind the colloids to the paper fibers by feeding certain chemical additives into the papermaking process water that will facilitate the pitch becoming associated with the paper fibers via direct or indirect binding.

The heterogenous chemical composition of pitch and stickies adds complexity and expense to its control. A range of hydrophobic chemicals can be present in pitch and additional hydrophobic chemicals may become associated with pitch during paper production. A common practice to control pitch has been to add alum as part of the chemical pulping process. Soaps of resin acids formed during pulping will associate with alum and these complexes can serve to bind pitch particles to the fiber surface. More recently, highly cationic polymers are added to paper process streams to retain pitch onto the fiber. This is a very important process as it provides a path for the pitch to be continuously removed from the paper process water.

Certain conventional monomeric organic and inorganic chemicals have been shown to be effective in dispersing pitch particles thereby preventing deposition on surfaces of papermaking equipment. Compounds such as sodium polyacrylate and arylsulfonic acid condensates have been shown to be useful for preventing pitch.

Several different classes of chemicals have been reported to be effective in controlling deposition of pitch and stickies. These include surfactants, anionic polymers and copolymers composed of anionic monomers and hydrophobic monomers, talc, alum, bentonite, diatomaceous silica, starch, animal glue, gelatin and some other proteins, and some highly cationic polymers. Other substances include polymeric N-vinyl lactam, xylene sulfonic acid-formaldehyde condensates, and salts thereof, water soluble dicyandiamide-formaldehyde condensates, and certain water-soluble non-surface-active cationic quaternary ammonium salts. Nonylphenol ethoxylate compounds have been used to inhibit pitch deposition in papermaking systems.

European Patent Application 599 440 discloses a pitch dispersant composition comprising blends of certain nonionic surfactants and water-soluble cationic polymers.

European Patent Application EP 0568229A1 discloses that HMHEC (hydrophobically modified hydroxyethyl cellulose) and related molecules are effective in preventing deposition of pitch and stickies. However, this application only provided evidence that HMHEC is effective for preventing deposition.

Results reported by Shetty et al. (*Tappi J.* 77, 10: 91, 1994) teach how pitch control can be achieved by adding certain cationic polymers to the fiber furnish. For example, poly-DADMAC polymers promoted coalescence of pitch particles, allowing them to be retained in the paper.

The prior art teaches that certain combinations of chemicals can be effective in preventing pitch deposition while not affecting pitch retention. For example, Dreisbach et al. (U.S. Pat. No. 5,074,961) discloses that water soluble cellulose ethers selected from the group consisting of methyl cellulose, methyl hydroxyethyl cellulose, methyl hydroxypropyl cellulose, carboxymethyl methyl cellulose, and methyl hydroxybutyl methyl cellulose are effective in preventing pitch deposition while not adversely affecting sizing, fines retention, or pitch retention. Furthermore, it was disclosed that the cellulose ethers flocculated and retained pitch.

The prior art also teaches that certain chemicals can be used in combination to decrease pitch deposition while increasing pitch retention. Nguyen (U.S. Pat. No. 5,723,021) disclosed that a combination of polyvinyl alcohol, a high molecular weight gelatin, and a cationic polymer gave decreased deposition and increase retention of pitch in a paper process system.

SUMMARY OF THE INVENTION

It has been found that when hydrophobically modified hydroxyethyl cellulose (HMHEC) and cationic polymers are added to a cellulosic fiber slurry (pulp) or paper process or paper making system, a higher degree of inhibiting organic deposition and retention of pitch on paper fiber is exhibited as compared to the inhibition of the individual ingredients. The combination of HMHEC and cationic polymers surprising results in a synergistic effect. Because of the enhanced activity of using a combination of HMHEC and certain cationic polymers, the total quantity of the deposition inhibitor and retention aid may be reduced.

DETAILED DESCRIPTION OF THE INVENTION

Figure 1:
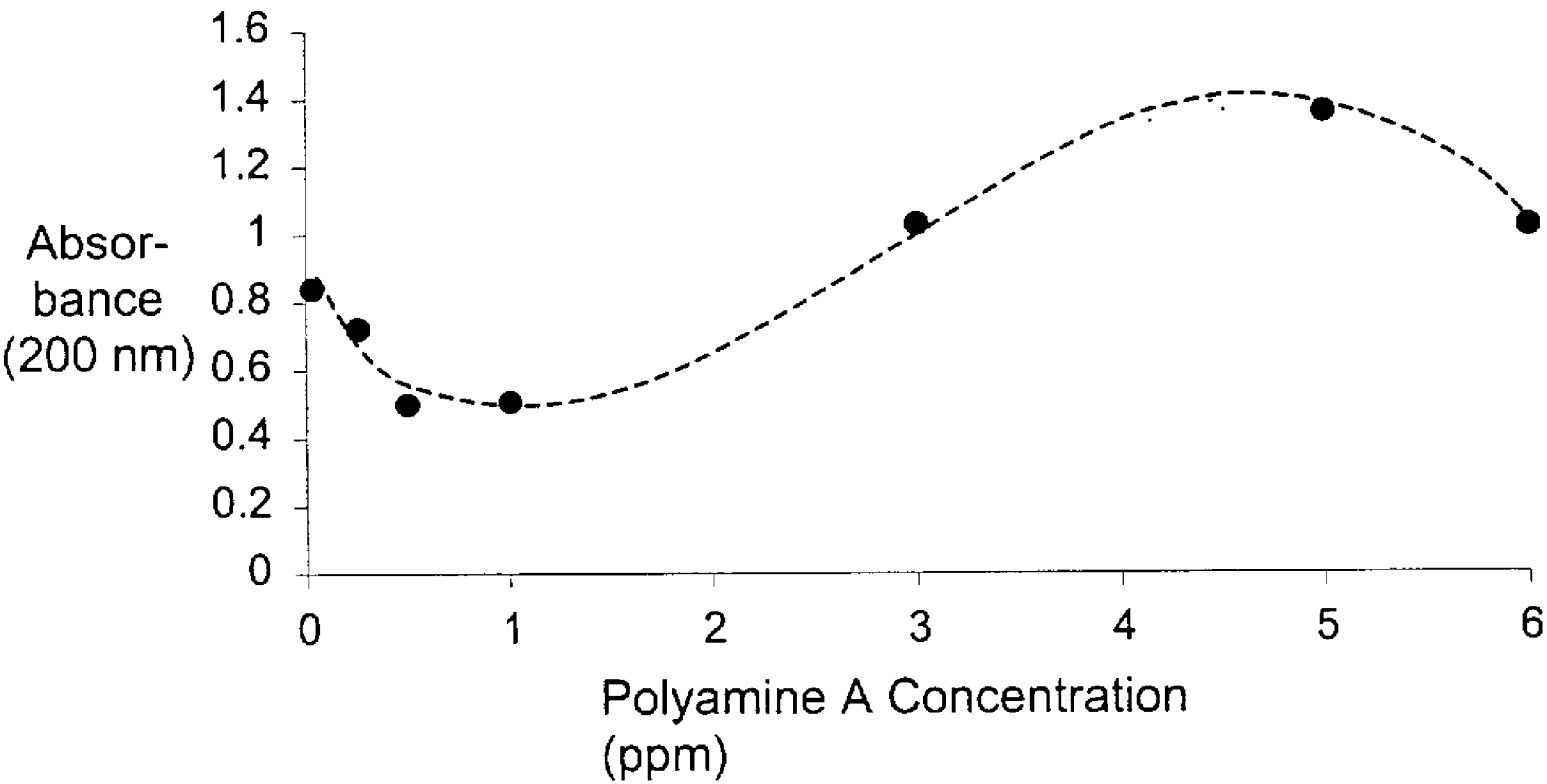
FIG. 1. Effect of polyamine A concentration vs. absorbance (deposition).

The present invention relates to a synergistic combination of components and methods for inhibiting deposition of organic contaminants from pulp on the surfaces of papermaking equipment in pulp and papermaking system comprising adding to the pulp or to the surface of the papermaking machinery an effective deposition inhibiting amount of a combination of components comprising hydrophobically-modified hydroxyethyl cellulose (HMHEC) and a cationic polymer. The combination of HMHEC and a cationic polymer produces a synergistic effect.

Organic contaminants include constituents which occur in the pulp (virgin, recycled or combinations thereof) and have the potential to form deposits thereby reducing paper machine performance or paper quality. Organic contaminants include both pitch and stickies. Examples of organic contaminants include, but are not limited to, natural resins such as fatty acids, resin acids, their insoluble salts, fatty esters, sterols, waxes, adhesives, latex, sizing agents, and defoamers which may deposit in papermaking systems.

One of the components used in the present invention is hydrophobically modified hydroxyethyl cellulose (HMHEC). HMHEC is a general descriptor of a family of chemical compounds that are based on hydroxyethyl cellulose (HEC) substrate and differ by what n-alkyl moieties are attached, the amount of hydrophobes, as well as the type of linkage between the cellulose substrate and the attached moiety. HMHEC is usually prepared from HEC by chemically incorporating a hydrophobic n-alkyl moiety generally having from 2 to more than 20 carbon atoms, onto the HEC. The hydrophobe can be linear or branched and is attached to the cellulose via an ether or ester linkage. The amount of hydrophobe incorporated will be dependent upon the intended use. The chemical and physical characteristics of HMHEC are determined by the number of carbon atoms in the hydrophobe, amount of hydrophobes, as well as the type of linkage that connects the hydrophobe to the HEC substrate.

HMHEC is useful in a range of applications and functions including, but not limited to, photographic paper, pharmaceutical applications as part of sustained release polymer, viscosity stabilizers, thickeners for emulsion paints, as a thickener in cleaning compositions, and for stabilizing dispersions containing paper sizing agents.

The present invention demonstrates HMHEC as part of a deposition control program that includes preventing deposition and retention of the contaminants on paper fiber in conjunction with a cationic polymer. Thus, the present invention not only provides a method to prevent deposition but also retention of the pitch so that it can be removed from a paper process system.

An example of a hydrophobically modified hydroxyethyl cellulose (HMHEC) component of this invention is commercially available as a fluidized polymer from Aqualon Company (Wilmington, Del.) as Natrosol™ Plus 330 FPS.

The HMHEC can have hydrophobes varying from about 2 carbon atoms in length to about 22 carbon atoms in length. Preferred hydrophobes can range from 4 to 22 carbons in length, can range from 6 to 22 carbons in length, can range from 8 to 22 carbons in length, can range from 6 to 20 carbons in length or can range from 8 to 20 carbons length.

The amount of HMHEC useful in the present invention varies depending on the source of the cellulosic fiber. Preferred amounts can range from 0.5 ppm to about 50 ppm. The amount can be at least about 0.5 ppm, or at least about 1 ppm or at least about 2 ppm or a least about 3 ppm or a least about 4 ppm or at least about 5 ppm or at least about 6 ppm or at least about 10 ppm or a least about 20 ppm. The amount can be as high as 40 ppm or as high as 50 ppm or as high as 100 ppm or as high as 200 ppm.

The second component of the present invention is a cationic polyamine-based polymer. Polyamines and related polymerics are frequently used in paper production, often to improve the dry strength of paper (see generally U.S. Pat. No. 3,840,489). Polyamines are useful to enhance dry strength of paper because they are substantive to cellulose fibers.

Certain polyamines and related polymerics are frequently used in paper production, often to improve the dry strength of paper. These polyamines are also useful in the present invention. Certain polyamines are useful to enhance dry strength of paper because they are substantive to cellulose fibers. Such cationic polymers generally are protonated or quaternary ammonium polymers such as the reaction product between an epihalohydrin and one or more amines; polymers derived from ethylenically unsaturated monomers which contain an amine or a quaternary ammonium group; and acrylamide copolymers produced from the reaction of acrylamide and ethylenically unsaturated cationic monomers. Such cationic polymers can be derived from the reaction of an epihalohydrin, preferably epichlorohydrin, with dimethylamine, ethylene diamine, and a polyalkylene polyamine. Preferred cationic polymers include the reaction product of an epihalohydrin with dimethylamine, diethylamine, or methylethylamine. More preferred cationic polymers include polyamine and polyethyleneimine (PEI).

Cationic polymers useful in the present invention include polymers produced by co-polymerization of cationic monomers with acrylamide. Typical cationic monomers used in this co-polymerization include, but are not limited to, the aminoalkylacrylate esters and their quaternary ammonium salts (quaternized with such quaternizing agents as methyl chloride, dimethyl sulfate, benzyl chloride and the like); the ammonialkylmethacrylate esters and their corresponding quaternary ammonium salts; the aminoalkylacrylamides and their corresponding quaternary ammonium salts; the aminoalkylmethacrylamides and their corresponding quaternary ammonium salts; the diallyldialkylammonium salt monomers; the vinylbenzyltrialkylammonium salts; and the like.

Mixtures of the cationic monomers together with acrylamide to prepare the cationic polymers are also useful in this invention. The instant invention also contemplates homopolymers of the cationic monomers, as well as copolymerization of mixtures of cationic monomers without acrylamide as useful. Non-limiting examples of cationic monomers that can be used in cationic polymers of the present invention include: diallyldiethylammonium chloride; diallyldimethylammonium chloride (DADMAC); acryloyloxyethyltrimethylammonium chloride (AETAC); methacryloyloxyethyltrimethylammonium chloride (METAC); methacrylamidopropyltrimethylammonium chloride (MAPTAC); acrylamidopropyltrimethylammonium chloride (APTAC); acryloyloxyethyltrimethylammonium methosulfate (AETAMS); methacryloyloxyethyltrimethylammonium methosulfate (METAMS); acryloyloxyethyldiethylmethylammonium chloride; methacryloyloxyethyidiethylmethylammonium chloride; methacryloyloxyethyldiethylmethylammonium chloride; and methacryloyloxyethyldiethylmethylammonium chloride.

The cationic polymers useful in the present invention can have molecular weight of at least about 50,000 or at least about 100,000 or a least about 200,000. The molecular can be as high as 2,000,000 or 1, 500,000 or 1,000,000 or 750,000 or 5,000,000. One preferred range is from about 100,000 to about 1,000,000. Another preferred range is from about 200, 000 to about 750,000.

The amount of cationic polymer useful in the present invention varies depending on the source of the cellulosic fiber. Preferred amounts can range from 0.5 ppm to about 50 ppm. The amount can be at least about 0.5 ppm, or at least about 1 ppm or at least about 2 ppm or a least about 3 ppm or a least about 4 ppm or at least about 5 ppm or at least about 6 ppm or at least about 10 ppm or a least about 20 ppm. The amount can be as high as 40 ppm or as high as 50 ppm or as high as 100 ppm.

The amount of HMHEC to cationic polymer can vary depending on the system being treated. Preferred ratios of HMHEC: cationic polymer range from about 1:10 to 10:1. Other ranges are from 1:6 to 6:1 and from 3:1 to 1:3. Additional preferred ranges include from 1:1 to 10:1 and 1:1 to 6:1.

The components of the present invention may be compatible with other pulp and papermaking additives. These can include starches, fillers, titanium dioxide, defoamers, wet strength resins, and sizing aids.

The components of the present invention can be added to the papermaking system at any stage in a simultaneous or sequential manner. They may be added directly to the pulp furnish or indirectly to the furnish through the headbox. The components may also be sprayed onto the surfaces that are suffering from deposition, such as the wire, press felts, press rolls and other deposition-prone surfaces.

The components of the present invention can be added to the papermaking system neat, as a powder, slurry or in solution; the preferred primary solvent for the components be water but is not limited to such. The preferred method of delivery is to dilute the HMHEC with water for a time sufficient for the HMHEC to dissolve partially or completely before it is fed into the process system. The cationic polymer is fed simultaneously or sequentially at a rate to give an effective concentration in the process water or on the surface of papermaking equipment. The inventive combinations of components may be added specifically or only to a furnish identified as containing contaminates. The inventive combinations of components may be added to blended pulps wherein at least one of the pulps is contains contaminates. The combinations may be added to the stock at any point prior to the manifestation of the deposition problem and at more than one site when more than one deposition site occurs. Combinations of the above additive methods may also be employed: feeding either the HMHEC or cationic polymer separately, feeding the pulp millstock, feeding to the paper machine furnish, or spraying on the wire and the felt simultaneously. The components can be added simultaneously or sequentially. The HMHEC can be added first followed by the cation polymer or the cationic polymer can be added first followed by the HMHEC.

There are several advantages associated with the present invention as compared to prior processes. These advantages include an ability to decrease pitch deposition while increasing retention of pitch on the fiber, an ability to function without being greatly affected by hardness of the water in the system; an ability to function while not adversely affecting sizing and fines retention; an ability to function at very low dosages; reduced environmental impact; and improved biodegradability.

The data set forth below were developed to demonstrate the synergistic effects of the present invention. The following examples are included to illustrate a few embodiments of the invention and should not be construed as limiting the scope thereof.

EXAMPLES

Example 1

This example demonstrates how the present invention controls pitch in a pulp suspension. Measurements were made on the amount of pitch depositing on a surface and the amount retained on the pulp. The two measurements demonstrate whether a treatment program controls pitch by decreasing the quantity of pitch depositing or decreasing deposition and cleaning of the system by retention of the pitch on the pulp. The most preferred treatment program results in a high percentage of deposit reduction as well as a high percentage of turbidity reduction.

A polypropylene film was immersed in a 0.5% (w/v) consistency kraft pulp slurry containing 350 parts per million (ppm) of a laboratory pitch emulsion. The pulp slurry was contained in a glass beaker and agitated provided by a magnetic stirring bar spinning at 300 rotations per minute (rpm). The glass beaker was maintained in a 50° C. water bath. The slurry (pH=6.0) contained 0.5% hardwood kraft fiber, 350 parts per million laboratory pitch having fatty acids, resin acids and fatty esters (ratio 2:4:3) and 200 ppm calcium expressed as calcium derived from calcium chloride. A piece of polypropylene film held in a plastic frame was immersed in the pulp slurry for 45 minutes. After the 45-minute incubation period, the film was gently rinsed with deionized water to remove the pulp fibers and air-dried. The first measurement was then made in which the amount of pitch depositing on the polypropylene film was determined by measuring the absorbance at 6 different positions on the film at 200 nm with an UV-Vis spectrophotometer. The average absorbance at 200 nm is a measure for the total deposition.

The second measurement determined the amount of pitch that was retained by the pulp. In this measurement, after the film was removed the pulp slurry was centrifuged at a speed of 3733 rpm in a MSE Mistral 200. This provided a force of 500×g. A centrifugal force of 500×g was found optimal for separating the cellulose fibers from the water while leaving smaller particles in suspension. A sample of the fiber-free water was then collected and the turbidity of that water was determined.

In the first series of experiments, the effects of additions of polyamine A and HMHEC (Hydrophobically Modified HydroxyEthyl Cellulose) alone and together were determined. The polyamine A is a cationic polyamine made from dimethylamine, epichlorohydrin and ethylene diamine, $M_w$=500,000, commercially available as Zenix® DC7479 from Hercules Incorporated, Wilmington, Del.) and HMHEC is commercially available as Natrosol® Plus 331 from Aqualon Inc., Wilmington, Del. As is evident in FIG. 1, as the amount of polyamine A added to the test system increased, there was a resulting decrease in deposition on the polypropylene film but as the concentration increased above 1 ppm, the amount of deposition increased up to 5 ppm polyamine A. Above 5 ppm, deposition decreased to a level detected at 1 ppm polyamine A.

Figure 2:
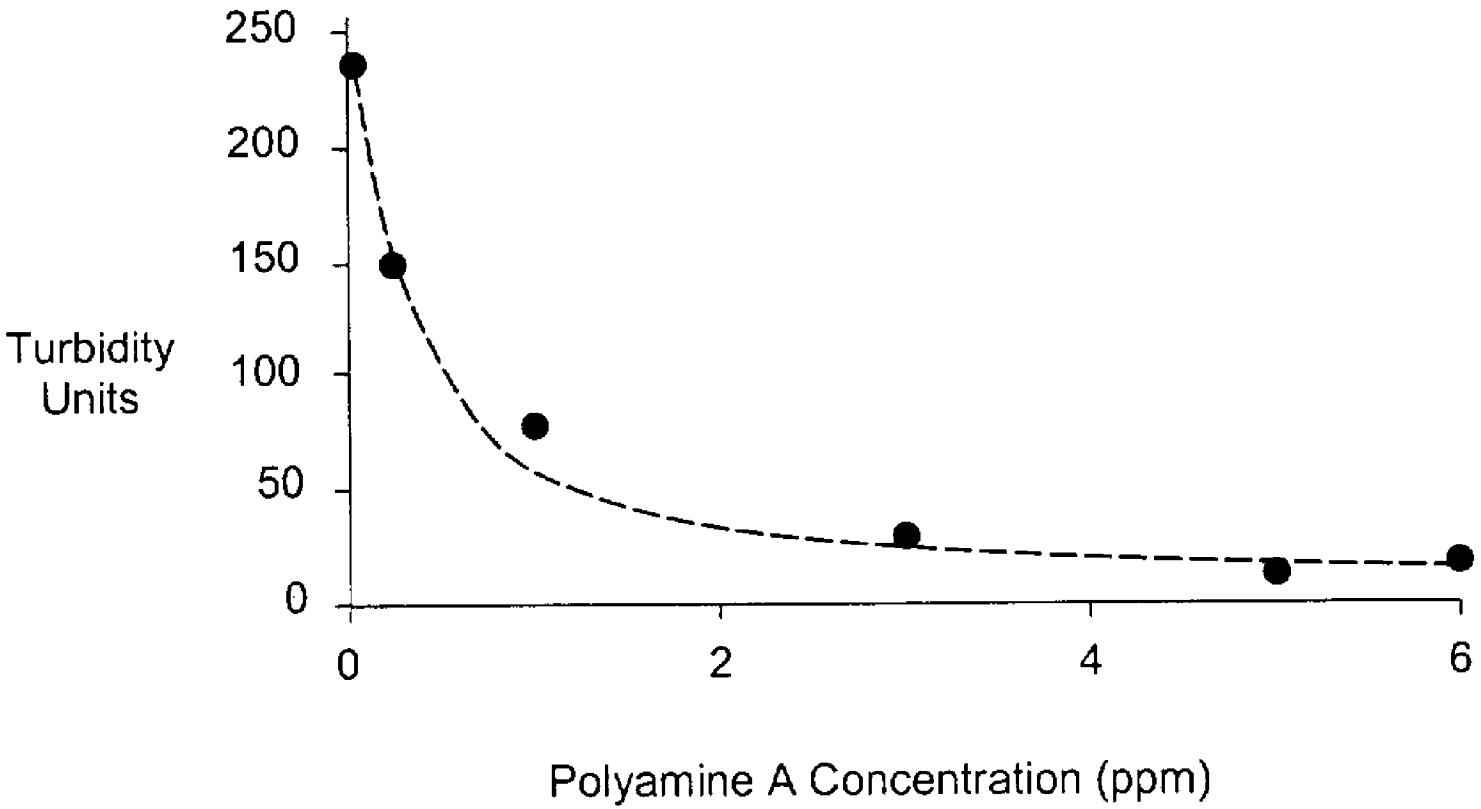
FIG. 2. Effect of Polyamine A on turbidity.

The effect of polyamine A on turbidity was less complex than that on deposition as indicated in FIG. 2. The turbidity decreased rapidly with increasing concentration of polyamine up to 5 ppm above which, there was only a slight decrease in turbidity.

Figure 3:
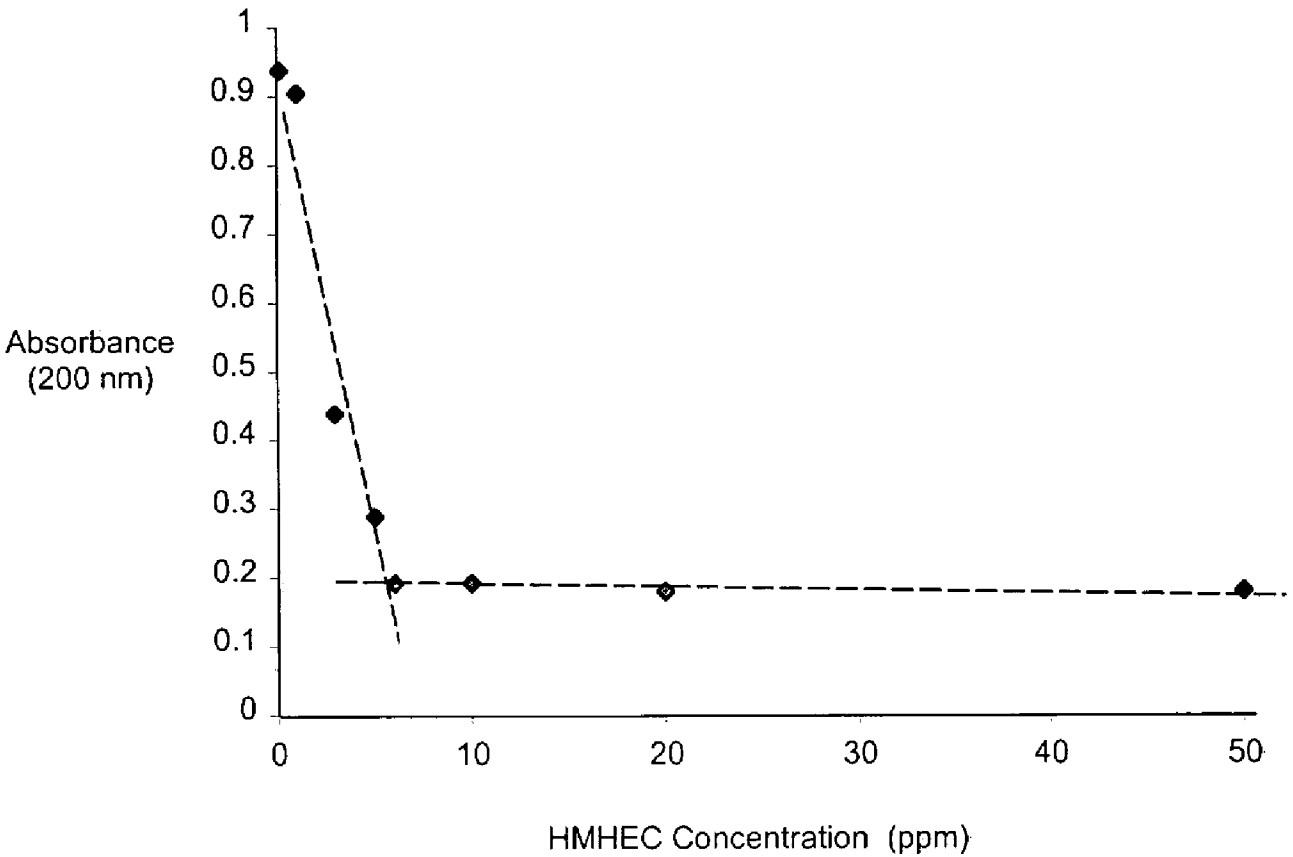
FIG. 3. Effect of HMHEC on absorbance.

The change in absorbance resulting from HMHEC treatment showed a response that was characterized by a deflection point as indicated in FIG. 3. As the concentration increased up to 6 ppm, there was a sharp decrease in absorbance, indicating that deposition was effectively inhibited. Increasing the concentration above 6 ppm had little effect on deposition.

Figure 4:
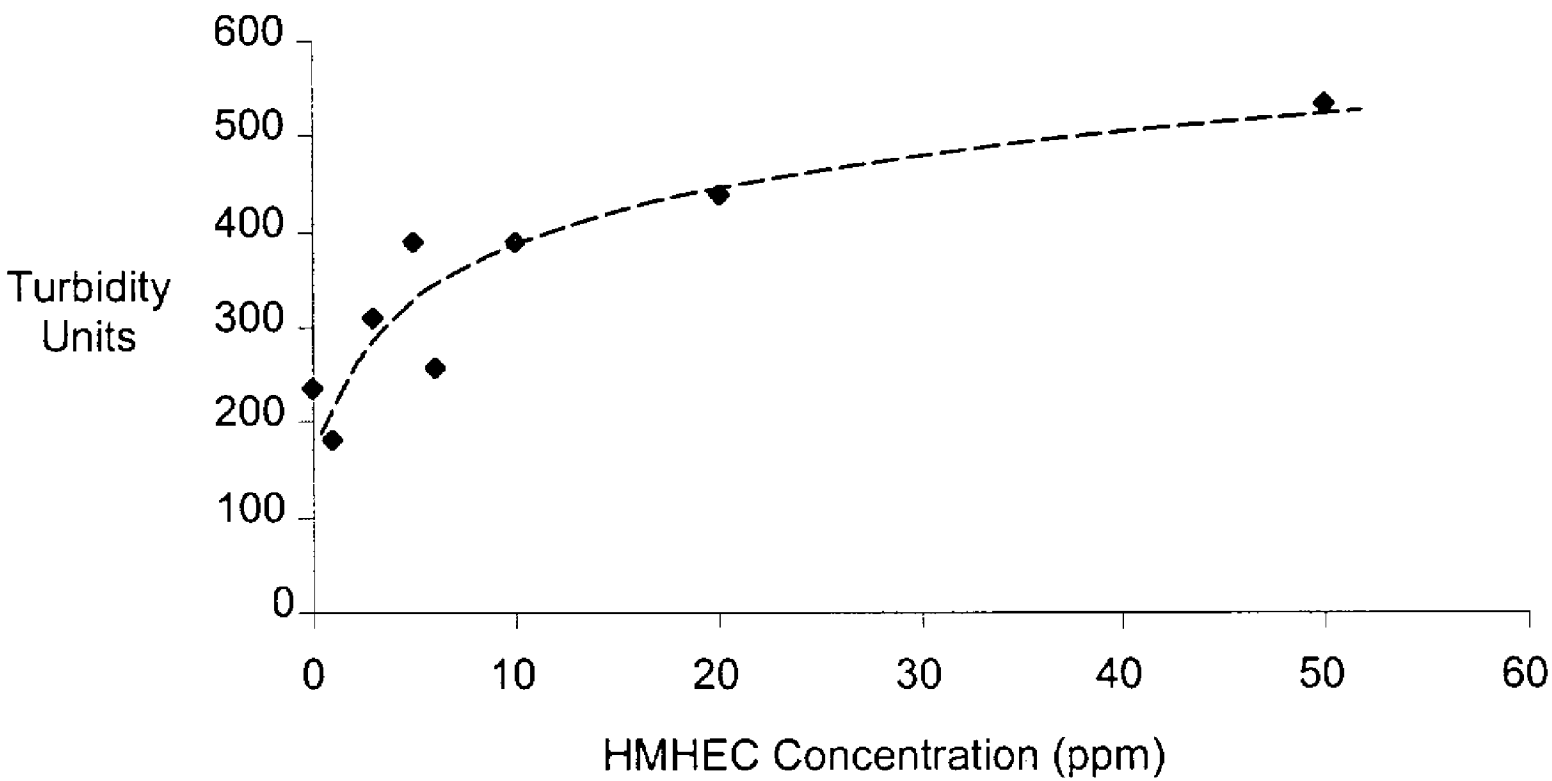
FIG. 4. Effect of HMHEC on absorbance.

The effect of HMHEC on turbidity as demonstrated in FIG. 4 shows and opposite effect. There was a significant increase in turbidity as the concentration of HMHEC was increased. Above 10 ppm, the rate of increase in deposition in response to more HMHEC being added was much less than that detected at 10 ppm or less.

A series of studies were carried out to demonstrate the effect of additions of HMHEC and Polyamine A on deposition and turbidity in the test system. A baseline for absorbance and turbidity values in untreated systems was established. Mean values of 0.82 for absorbance (at 200 nm) and 182 for turbidity were obtained for 13 independent experiments. The mean absorbance and turbidity values were then compared to results over a range of concentrations of Polyamine A and HMHEC. The approach to this was to use the equations that described the dose-response relationships in FIGS. 1–4 to predict the effect of selected concentrations of Polyamine A and HMHEC on absorbance and turbidity. If the two materials were acting in an additive manner, the effect on turbidity and deposition would be the sum of the individual effects. If the effect was less than that predicted, the two materials would be acting in an antagonistic manner. Conversely, if the measured effect was greater than that predicted, a synergistic effect would be occurring.

One part per million Polyamine A gave maximum decrease in absorbance (see FIG. 1) and a significant decrease in turbidity. Therefore, 1 ppm Polyamine A was selected to test a range of concentrations of HMHEC (see Table 1) and the results were compared to untreated controls.

Figure 5:
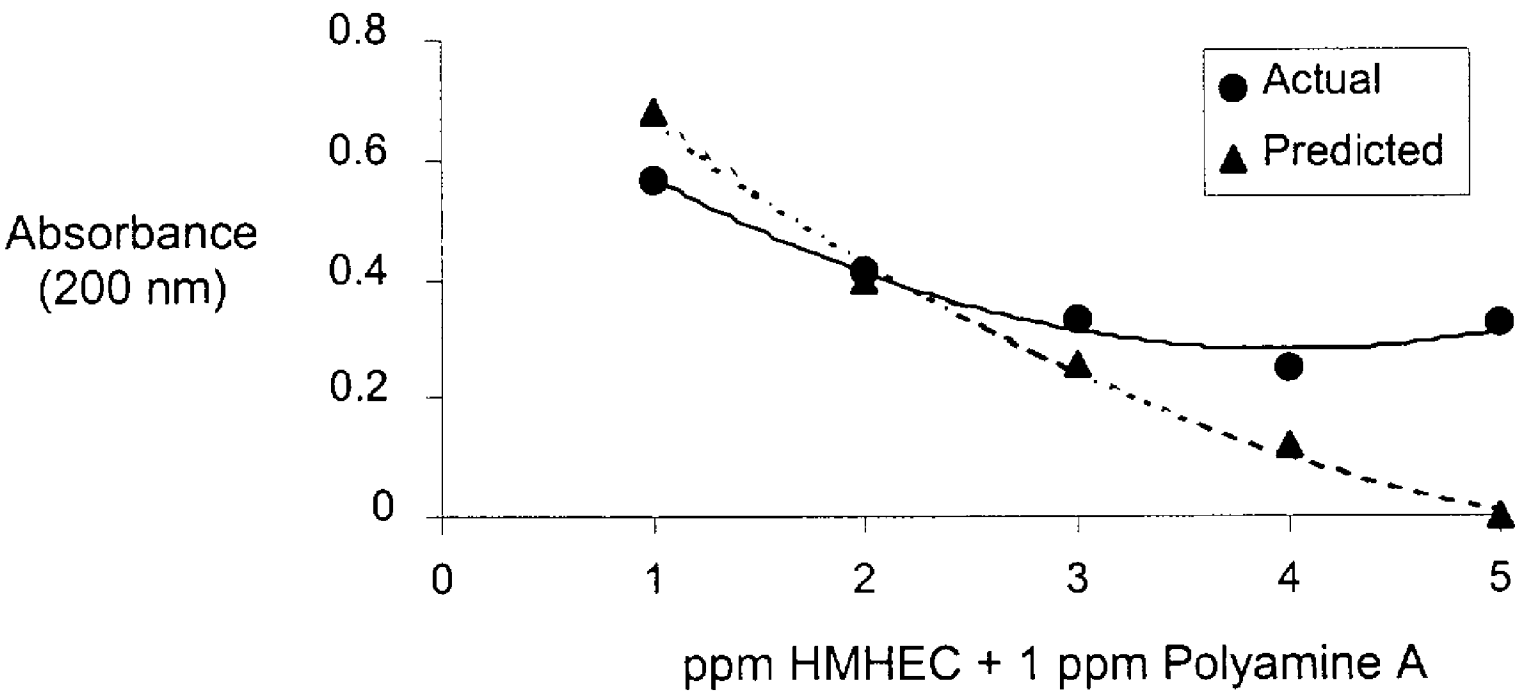
FIG. 5. Effect of combinations of Polyamine A and HMHEC.

As indicated in FIG. 5, the concentrations of HMHEC tested were 1, 2, 3, 4, and 5 ppm. As the concentration of HMHEC increased from 1 ppm to 5 ppm, there was an unexpected divergence in the plots of predicted versus actual absorbance readings. This indicates that the two materials can interact in an additive manner in a certain concentration range but the effect on deposition changes with the total amount of materials added and/or the ratio of the active materials added.

Other concentrations and ratios of the actives were tested to evaluate more accurately evaluate the nature of the effects on deposition between HMHEC and polyamine A. The results of those assays are presented in Table 2.

TABLE 2

Effect of selected concentrations and ratios of Polyamine A and HMHEC on predicted and actual results in pitch deposition assays.

| Polyamine A Concentration (ppm) | HMHEC Concentration (ppm) | Predicted* Absorbance | Actual Absorbance | Predicted** Turbidity | Actual Turbidity |
|---|---|---|---|---|---|
| 1 | 1 | 0.53 | 0.56 | 52 | 92 |
| 1 | 2 | 0.40 | 0.39 | 111 | 100 |
| 1 | 3 | 0.26 | 0.29 | 146 | 124 |
| 1 | 4 | 0.12 | 0.23 | 170 | 142 |
| 1 | 5 | −0.02 | 0.20 | 189 | 179 |
| 1.5 | 4.5 | 0.09 | 0.19 | 165 | 124 |
| 3 | 1 | 1.02 | 0.62 | 18 | 47 |
| 3 | 3 | 0.74 | 0.26 | 112 | 75 |
| 3 | 5 | 0.47 | 0.18 | 156 | 102 |
| 4.5 | 1.5 | 1.35 | 0.44 | 46 | 39 |
| 5 | 3 | 1.14 | 0.34 | 104 | 49 |
| 5 | 5 | 0.86 | 0.19 | 148 | 80 |

Absorbance values were calculated with the equations.
For polyamine A: absorbance = $-0.0361x^3 + 0.3135x^2 - 0.5418x + 0.7741$ where x = ppm polyamine A.
For HMHEC: absorbance = $-0.1375x + 0.972$ where x = ppm HMHEC.
**values were calculated using the following equations:
For Polyamine A: Turbidity = $59.85x^{-0.7473}$ where x = ppm polyamine A.
For HMHEC: Turbidity = 85.674Ln(x) + 188.56 where x = ppm HMHEC.

TABLE 1

Effect of selected concentrations of Polyamine A and HMHEC on absorbance and turbidity values in pitch control assays

| Treatment | ppm added | Total ppm Added | Absorbance (200 nm) | Turbidity (NTU) |
|---|---|---|---|---|
| Control (Untreated) | 0 | 0 | 0.82 | 182 |
| Polyamine A | 1 | 1 | 0.51 | 79 |
| HMHEC | 1 | 1 | 0.90 | 134 |
| HMHEC | 3 | 3 | 0.416 | 263 |
| HMHEC | 5 | 5 | 0.282 | 317 |
| Polyamine A + HMHEC | 1 + 1 | 2 | 0.48 | 119 |
| Polyamine A + HMHEC | 1 + 2 | 3 | 0.39 | 100 |
| Polyamine A + HMHEC | 1 + 3 | 4 | 0.30 | 128 |
| Polyamine A + HMHEC | 1 + 4 | 5 | 0.23 | 142 |
| Polyamine A + HMHEC | 1 + 5 | 6 | 0.20 | 179 |
| Polyamine A + HMHEC | 1.5 + 4.5 | 6 | 0.20 | 123 |
| Polyamine A + HMHEC | 3 + 1 | 4 | 0.62 | 47 |
| Polyamine A + HMHEC | 3 + 3 | 6 | 0.27 | 74 |
| Polyamine A + HMHEC | 3 + 5 | 8 | 0.18 | 102 |
| Polyamine A + HMHEC | 3 + 3 | 6 | 0.25 | 76 |
| Polyamine A + HMHEC | 4.5 + 1.5 | 6 | 0.44 | 39 |
| Polyamine A + HMHEC | 5 + 3 | 8 | 0.34 | 49 |
| Polyamine A + HMHEC | 5 + 5 | 10 | 0.19 | 80 |

Figure 6:
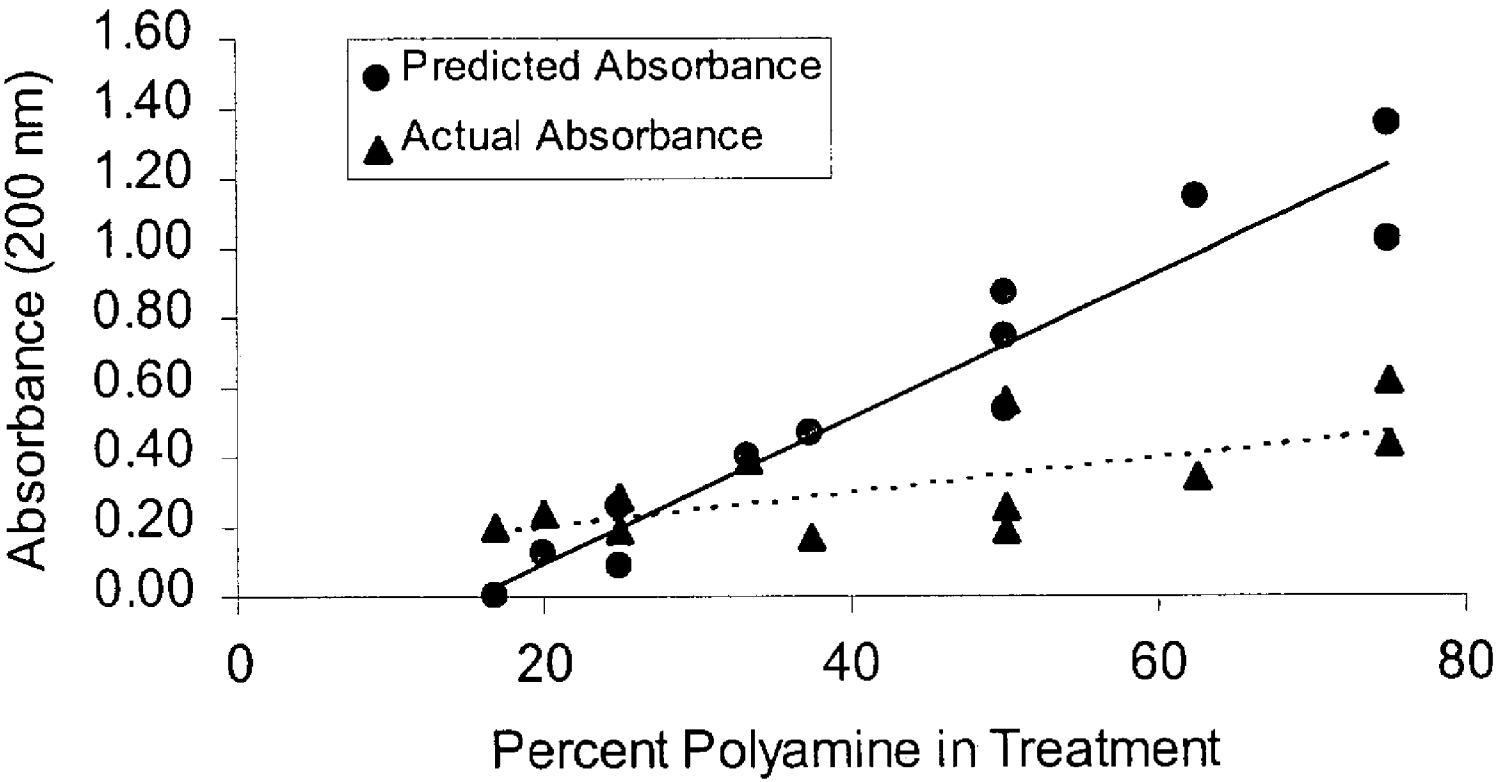
FIG. 6. Effect of percent polyamine on Absorbance.

The results presented in Table 2 that document the synergistic effect of combinations of Polyamine A and HMHEC in the test system are more obvious when compared to the actual composition of the combined treatments. For example, in FIG. 6, the predicted and actual values presented in Table 2 are compared to the percentage of polyamine A in the total the treatment. In this case, as the percentage of Polyamine A in the combined treatment increased, the divergence of the predicted versus actual values increased. The combined treatment program was significantly more effective as the proportion of Polyamine A increased.

Example 2

In order to determine whether polyamines other than Polyamine A would be effective in combination with HMHEC, other materials were tested. As indicated in Table 3, Polyamine B, having a molecular weight of approximately 50,000, did not show a synergistic effect when combined with HMHEC.

TABLE 3

Effect of polyamine B on absorbance and turbidity values in the pitch deposition assay.

| Polyamine B Concentration (ppm) | HMHEC Concentration (ppm) | Predicted Absorbance | Actual Absorbance | Predicted Turbidity | Actual Turbidity |
|---|---|---|---|---|---|
| 1 | 0 | 0.38 | 0.34 | 53 | 106 |
| 1 | 1 | 0.41 | 0.55 | 76 | 76 |
| 1 | 2 | 0.05 | 0.41 | 99 | 189 |
| 1 | 3 | −0.09 | 0.26 | 122 | 162 |
| 1 | 4 | −0.16 | 0.23 | 145 | 169 |
| 1.5 | 4.5 | −0.17 | 0.24 | 147 | 107 |
| 3 | 3 | −0.02 | 0.23 | 98 | 83 |
| 4.5 | 1.5 | 0.29 | 0.34 | 57 | 60 |

Example 3

Samples of whitewater, and thermo-mechanical pulp (TMP) were obtained from a newsprint mill in the southern part of the United States. The TMP was made from southern pine, a wood characterized by high extractives content. The sample of pulp was collected after hydrosulfite bleaching with and addition of alum. The white water also contained alum and other process chemicals. The TMP and whitewater samples were stored frozen and thawed shortly before the deposition tests were carried out. The TMP was diluted with white water to a consistency of 0.75%. Deposition tests were performed as described in Example 1 with the exceptions being the incubation period was increased from 45 minutes to 4 hours and the pH was 4.7. The results of those assays are present in Table 4 and FIGS. 7 and 8. As is evident in FIG. 7, except for four data points (indicated as unfilled diamonds), the predicted absorbance values were considerable larger than the actual measurements for all combinations. The four combinations that were above the predicted values contained the lower concentrations (e.g., 5 or 10 ppm) of Polyamine A.

TABLE 4

Effect of polyamine A and HMHEC on absorbance and turbidity in the pitch deposition assay using a papermill whitewater and pulp.

| HMHEC Concentration (ppm) | Polyamine A Concentration (ppm) | Predicted Absorbance | Actual Absorbance | Predicted Turbidity | Actual Turbidity |
|---|---|---|---|---|---|
| 0 | 0 | — | 0.26 | — | 48 |
| — | 10 | — | 0.23 | — | 83 |
| — | 20 | — | 0.18 | — | 49 |
| — | 50 | — | 0.17 | — | 85 |
| — | 100 | — | 0.20 | — | 53 |
| — | 200 | — | 0.17 | — | 28 |
| 10 | — | — | 0.17 | — | 61 |
| 20 | — | — | 0.15 | — | 123 |
| 50 | — | — | 0.19 | — | 150 |
| 100 | — | — | 0.20 | — | 226 |
| 200 | — | — | 0.15 | — | 428 |
| 50 | 5 | 0.22 | 0.12 | 177 | 114 |
| 50 | 10 | 0.21 | 0.09 | 186 | 137 |
| 50 | 20 | 0.19 | 0.10 | 155 | 73 |
| 20 | 10 | 0.19 | 0.33 | 136 | 51 |
| 10 | 10 | 0.18 | 0.22 | 123 | 46 |
| 20 | 20 | 0.17 | 0.11 | 150 | 74 |
| 5 | 5 | 0.19 | 0.23 | 108 | 30 |
| 50 | 50 | 0.17 | 0.13 | 216 | 30 |
| 10 | 20 | 0.17 | 0.12 | 137 | 28 |
| 5 | 10 | 0.17 | 0.22 | 116 | 33 |
| 5 | 20 | 0.15 | 0.09 | 130 | 42 |

Figure 8:
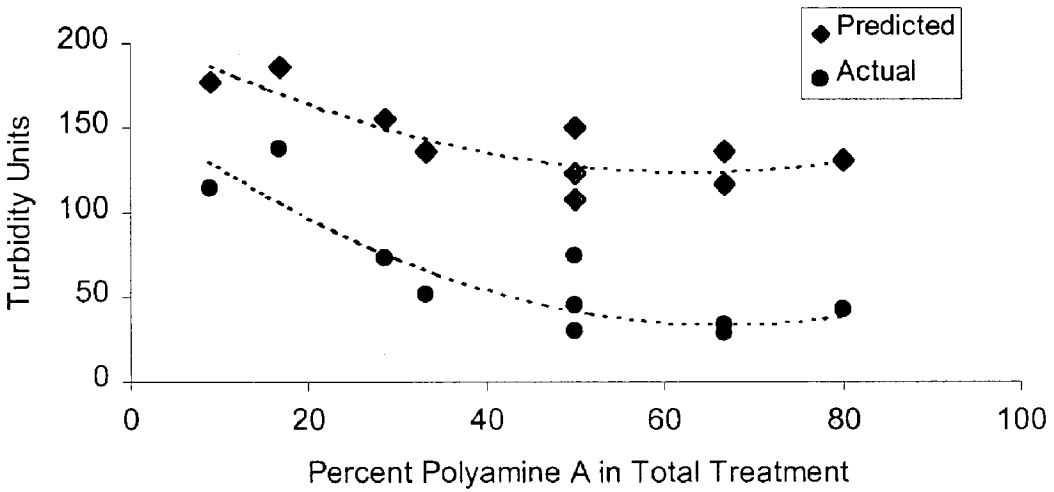
FIG. 8. Effects of combinations of Polyamine A and HMHEC on turbidity of a papermill whitewater containing 0.75% pulp.

As is evident in FIG. 8, the predicted values for turbidity of a papermill whitewater treated with selected combinations of Polyamine A and HMHEC were significantly greater than the actual measurements.

Figure 7:
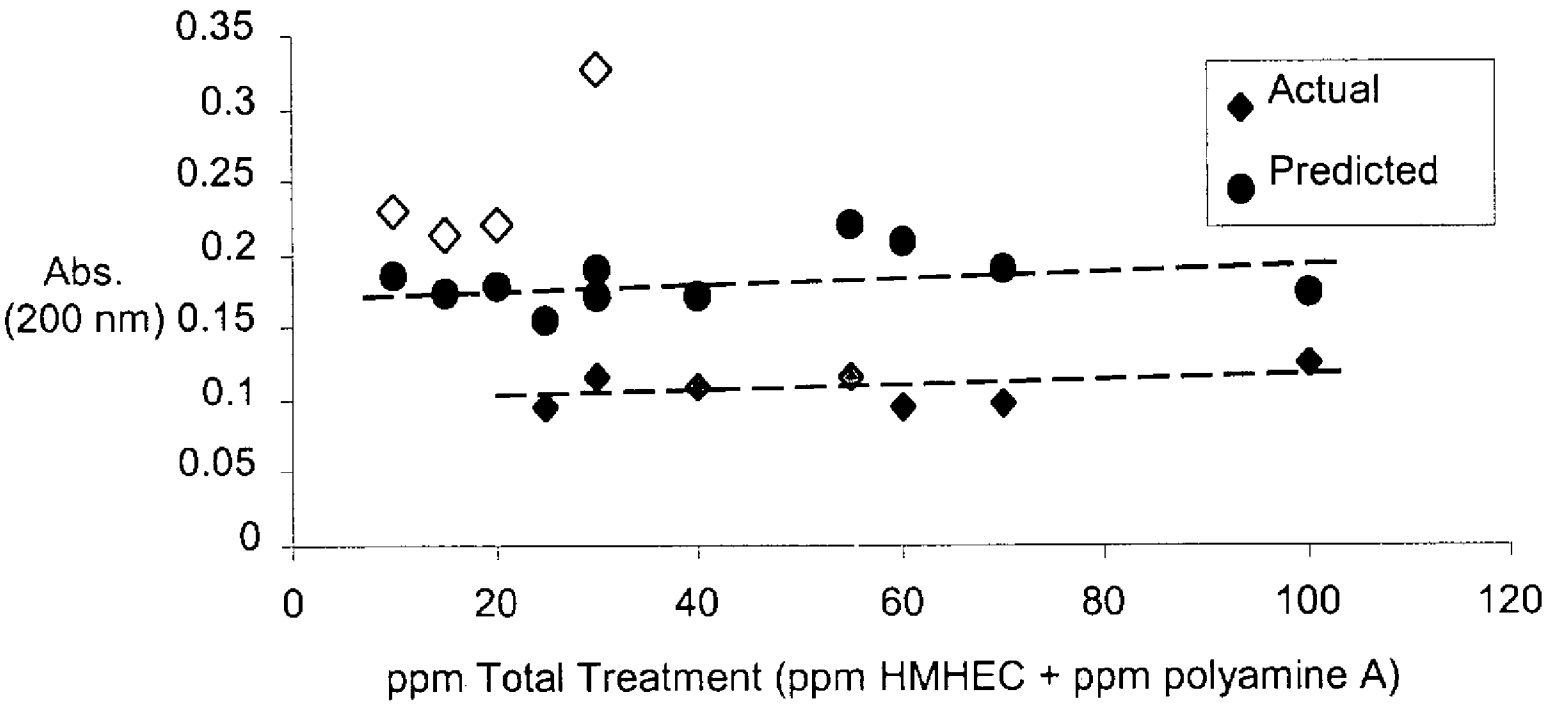
FIG. 7. Effect of HMHEC and Polyamine A on pitch deposition in a papermill whitewater.

As is evident in Table 4, FIG. 7, and FIG. 8, adding HMHEC and polyamine A to a mill whitewater sample results in less deposition and improved retention of pitch than adding a comparable amount of either active alone. FIGS. 7 and 8 demonstrate that the total amount of actives added and the ratio of the two actives are important to the outcome. The preferred ratio of HMHEC to polyamine A is in the range of about 1 to 1 to about 10 to 1 (see FIG. 8) although it is reasonable to expect that other ratios will be effective.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method for inhibiting the deposition of organic contaminants in pulp and papermaking systems, which method consists of treating the pulp and paper system with, separately a) a composition consisting of a hydrophobically modified hydroxyethyl cellulose; and b) a composition consisting of a cationic polymer.

2. A method according to claim 1, wherein the hydrophobically modified hydroxyethyl cellulose has hydrophobes between 8 and 22 carbon atoms in length.

3. A method according to claim 1, wherein the cationic polymer has a molecular weight between 100,000 and 1,000,000.

4. A method according to claim 3, wherein the molecular weight of the cationic polymer is a between 200,000 and 750,000.

5. A method according to claim 1, wherein the hydrophobically modified hydroxyethyl cellulose and the cationic polymer are delivered to the pulp and papermaking system or to the pulp in a carrier solvent.

6. A method according to claim 5, wherein the carrier solvent is water.

7. A method according to claim 1, wherein the hydrophobically modified hydroxyethyl cellulose and the cationic polymer are delivered to the pulp and papermaking system or to the pulp as a powder or a slurry.

8. A method according to claim 1, wherein the hydrophobically modified hydroxyethyl cellulose and the cationic polymer are added to the pulp and papermaking system or to the pulp by spraying.

9. A method according to claim 8, wherein the hydrophobically modified hydroxyethyl cellulose and the cationic polymer are sprayed onto the paper machine wire, paper machine felt, paper machine press roll or other surfaces prone to deposition.

10. A method according to claim 1, wherein the cationic polymer and the hydrophobically modified hydroxyethyl cellulose are added to the pulp and papermaking system or to pulp with a furnish.

11. A method according to claim 1, wherein the deposition of organic contaminants occurs on the surfaces of the pulp and papermaking systems.

12. A method according to claim 11, wherein the surface is selected from paper machine wire end paper machine wet felt.

13. A method according to claim 1, wherein the hydrophobically modified hydroxyethyl cellulose and the cationic polymer are added to the papermaking systems with other papermaking treatments.

14. A method according to claim 1, wherein hydrophobically modified hydroxyethyl cellulose and the cationic polymer are added to the paper machine stock or added directly to the contamination prone surface.

15. A method according to claim 1, wherein the hydrophobically modified hydroxyethyl cellulose is added to the system before the cationic polymer is added.

16. A method according to claim 1, wherein the cationic polymer is added to the system before the hydrophobically modified hydroxyethyl cellulose is added.

17. A method according to claim 1, wherein the cationic polymer and the hydrophobically modified hydroxyethyl cellulose are added to the system simultaneously.

18. A method for inhibiting the deposition of organic contaminants in pulp and papermaking systems, which method consists of treating the pulp and papermaking systems with:

a) a composition consisting of a hydrophobically modified hydroxyethyl cellulose; and b) a cationic polymer; and wherein the ratio of hydrophobically modified hydroxyethyl cellulose to the cationic polymer is in the range of about 1 to 10 to about 10 to 1.

19. A method according to claim 18, wherein the hydrophobically modified hydroxyethyl cellulose has hydrophobes between 8 and 22 carbon atoms in length.

20. A method according to claim 18, wherein the molecular weight of the cationic polymer is a between 200,000 and 750,000.

* * * * *